US006877890B2

(12) United States Patent
Whiteley

(10) Patent No.: US 6,877,890 B2
(45) Date of Patent: Apr. 12, 2005

(54) FLUID MIXER WITH ROTATABLE EDUCATOR TUBE AND METERING ORIFICES

(76) Inventor: Bruce Alan Whiteley, 44 Myamblah Crescent, Merewether New South Wales, 2291 (AU)

( * ) Notice: Subject to any disclaimer, the term of this patent is extended or adjusted under 35 U.S.C. 154(b) by 170 days.

(21) Appl. No.: 10/203,164

(22) PCT Filed: Oct. 30, 2001

(86) PCT No.: PCT/AU01/01412

§ 371 (c)(1),
(2), (4) Date: Nov. 25, 2002

(87) PCT Pub. No.: WO02/36267

PCT Pub. Date: May 10, 2002

(65) Prior Publication Data

US 2003/0137897 A1 Jul. 24, 2003

(30) Foreign Application Priority Data

Oct. 30, 2000 (AU) ..... PR1092
May 31, 2001 (AU) ..... PR5380

(51) Int. Cl.[7] ..... B01F 15/02
(52) U.S. Cl. ..... 366/163.2; 137/893
(58) Field of Search ..... 366/163.2; 137/888, 137/892, 893; 222/145.5, 145.6, 145.7; 239/318

(56) References Cited

U.S. PATENT DOCUMENTS

| | | | | | |
|---|---|---|---|---|---|
| 2,563,002 | A | * | 8/1951 | Bissell et al. | 366/163.2 |
| 3,067,435 | A | * | 12/1962 | Nash | 4/492 |
| 3,799,195 | A | * | 3/1974 | Hermans | 137/553 |
| 4,475,689 | A | * | 10/1984 | Hauger et al. | 239/318 |
| 4,901,923 | A | | 2/1990 | McRoskey et al. | |
| 5,544,810 | A | * | 8/1996 | Horvath et al. | 239/10 |
| 6,182,911 | B1 | | 2/2001 | Hanks et al. | |

FOREIGN PATENT DOCUMENTS

| | | |
|---|---|---|
| AU | 74490/74 | 4/1976 |
| WO | WO 93/02306 | 2/1993 |

* cited by examiner

*Primary Examiner*—David Sorkin
(74) *Attorney, Agent, or Firm*—Pearne & Gordon LLP

(57) ABSTRACT

A fluid or detergent mixer comprises a body (2) in which is located a rotatable eductor tube (4) with a venturi throat (17) and a knob (3) to rotate the tube. The mixer has a suction line (5) to draw detergent from the bottom of a detergent container (6) and mix it with the water as it flows and finally through the eductor via a control valve (13) and air gap (14). The eductor tube may have two or more metering orifices (22) which are brought, selectively, into alignment with the detergent suction line (5). For convenience the fluid mixer is supplied to the end user with the detergent container already attached.

16 Claims, 9 Drawing Sheets

FLUID MIXER WITH ROTATABLE EDUCATOR TUBE AND METERING ORIFICES

TECHNICAL FIELD

This invention relates to devices designed to mix one miscible fluid in relatively dilute concentrations with another fluid where the second fluid is available under pressure. More particularly this invention relates to a device capable of mixing detergent or other similar materials contained within a closed container with water from a regular water supply. Such devices find application in the cleaning of commercial premises where a solution of detergent and water are required to be mixed at a known concentration into a container for use in cleaning processes.

BACKGROUND ART

The cleaning of commercial premises, such as hospitals or schools, often uses diluted solution of water soluble solvents such as detergents which are supplied at a high concentration and then diluted with water at the cleaning site. In many cases the dilution with water is effected by simply pouring a quantity of the detergent into a receiving container and adding water. This process tends to be wasteful of detergent as most operators will mix at a concentration stronger than that required for the cleaning job at hand.

In some cases the concentrated detergent may present a health or other hazard in its fully concentrated form. Manually mixing this material with water allows the possibility of the operator to come into contact with the concentrated detergent with the consequent heath and safety risks.

To overcome these deficiencies devices have been manufactured and supplied to the cleaning industry which accept a supply of water under pressure and meter the detergent at a controlled rate to the water supply so that a solution of the correct concentration is presented to the receiving container. Such devices may meter the detergent flow by means of a dosing pump or by means of a venturi eductor. These devices are generally installed as a mixing station and are bulky, expensive and are not portable. These mixing stations require the operator to accept a container of detergent and to place a suction tube into the container this risking contact between the operator and the concentrated detergent.

It is the objective of this invention to provide a detergent mixer which is small, portable, cheap and disposable whilst still maintaining the performance characteristics of the much larger fixed mixing stations and which avoids any possibility of contact of the operator with the concentrated detergent.

DISCLOSURE OF THE INVENTION

This invention is a detergent mixer of the eductor type where a flow of water pressure through a venturi throat is used to provide suction pressure to draw detergent from a container and meter it with the water flow in a precisely controlled ratio. The detergent mixer may be supplied already assembled to a sealed container of detergent so that the operator at no time comes in contact with the concentrated detergent and simply has to connect a water supply from a hose and turn a control knob to obtain a supply of precisely proportioned detergent solution.

In one embodiment of the invention there is provided a fluid mixer comprising:

a body containing a rotatable eductor tube;

the eductor tube having one or more selectable metering orifices for drawing a first fluid into an internal throat area;

the body having a fitting through which the metering orifice may be accessed by a supply of the first fluid;

the body having an inlet above the eductor tube for a second fluid and a lower opening through which a lower portion of the eductor extends.

MODES FOR CARRYING OUT THE INVENTION

The operation of the detergent mixer and its inventive features are described with reference to FIGS. 1 to 10 which have identical numbering of the mixer components.

Figure 1:
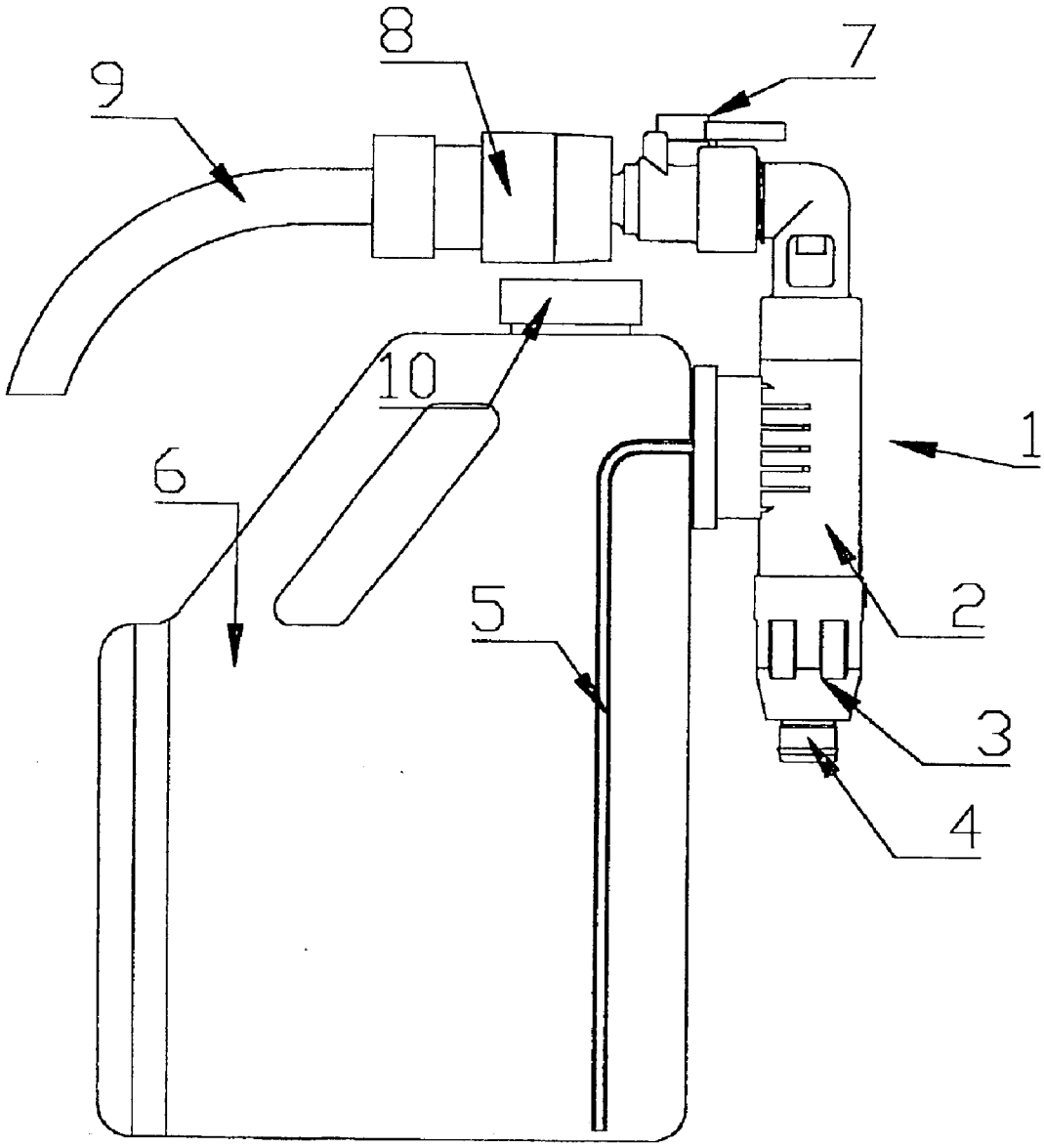
FIG. 1 is a general view of the detergent mixer assembly coupled to a detergent bottle and a hose to supply water at mains pressure.

FIG. 1 shows the detergent mixer assembly 1 which comprises a hose 9 to supply water under pressure which is connected to a valve 7 to start and stop the flow of water. The connection of the hose to the valve may by means of a conventional garden quick connect hose connector 8.

The detergent mixer has a body 2 to contain an eductor tube 4 and a knob 3 to rotate the eductor tube. The body of the detergent mixer connects to the detergent container 6 which may have a separate filling opening 10.

The detergent mixer has a suction line 5 to draw detergent from the bottom of the detergent container and mix it with the water as it flows through the eductor tube.

The invention will now be described in greater detail with reference to FIG. 2.

Water at full town pressure which may be as high as 800 kPa enters the shut off valve through a flow controlling element 13 which controls the flow rate of water to a substantially constant value independent of the water supply pressure. The shut off valve is a conventional valve with a ball 12 to start and stop the flow of water and a lever 11 to enable manual operation of the valve. The valve need not necessarily be a ball valve as any style of valve to start and stop the flow of water is suitable. The flow controlling element need not necessarily be upstream of the valve, and at low supply pressures the flow controlling element is not required.

After leaving the flow control valve the water enters an accurately sized delivery orifice 15. This orifice is accurately sized in relation to the passages in the eductor tube 4 to be later described.

There is an air gap 14 between the delivery orifice and the tapered entry 16 to the eductor tube 4. The air gap is to prevent the contamination of the town water supply with detergent from the detergent bottle in the event of a loss of mains water pressure and subsequent back siphonage into the town water main pipeline system.

The eductor tube has a venturi throat 17 which is accurately sized in relation to the delivery orifice 15. The tapered entry 16 to the venturi throat 17 is designed to permit some misalignment of the stream of water from the delivery orifice with the venturi throat and to ensure that the stream of water attaches to the venturi throat without splashing back into the air gap.

The eductor tube has a tapered delivery section 18 which keeps the water stream attached to the tube while its velocity slows to exit the tube at a relatively low velocity. When the detergent mixer is in operation with water flowing through it the water velocity in the venturi throat is in the order of 14 meters per second and the water velocity at exit from the eductor tube is in the order of 1.8 meters per second. The static pressure at the tube exit is atmospheric at approximately 100 kPa absolute. After allowing for friction pressure losses and applying the Bernoulli hydraulic equations the static pressure in the venturi throat is in the order of 10 kPa absolute.

The venturi throat of the eductor tube has a small orifice 22 which is connected to the suction tube 5 which is immersed in the detergent in the container 6. The air space at the top of the detergent container is connected to atmospheric pressure through a vent port 23 and a special fitting 24 on the eductor tube which will be explained in greater detail later.

The difference in static pressure between the pressure in the detergent container and the venturi throat causes the detergent in the container to flow into the venturi throat and mix with the water passing through the throat. The exact mixing ratio of detergent to water is determined by the viscosity of the detergent and the diameter of the small orifice 22. The mixing ratio of the detergent to the water is relatively independent of the rate of water flow through the detergent mixer provided the flow rates are such that the absolute pressure in the venturi throat is greater than the vapour pressure of the detergent. This relative independence is caused by the fact that the absolute pressure in the venturi throat is atmospheric pressure less a function of the square of the water velocity and the flow rate of the detergent is a function of the square root of the pressure differential between atmosphere and the venturi throat. The net result is that the flow velocity of the detergent through its metering orifice 22 is directly proportional to the velocity of the water through the venturi throat.

The accurate mixing ratio of the detergent and water will only remain constant if the absolute pressure in the venturi throat is greater than the vapour pressure of both the water and detergent. If the pressure is lower then one of the two liquids will vaporise and the mixing ratio will be lost. This event may be avoided by limiting the maximum velocity of the water in the venturi throat to approximately 14 meters per second. The water velocity is limited by limiting the flow rate by means of the flow controlling element 13 which will now be described.

With reference to FIGS. 5*a* to 5*d* the flow controlling element 13 is comprised of a housing which has raised ribs 36 which contact an elastomeric element 28 in the form of an O-ring. The flow controlling element housing has through passages 38 for the water flow which permit the water to pass from one side of the housing to the other. The housing also has a channel 37 which is not essential to permit the evening of the water flow through the discharge passages 38. The elastomeric O-ring 28 is on the upstream side of the flow controlling element.

As the water supply pressure increases the flow rate of water through the controlling element would increase in proportion to the square root of the pressure differential across the controlling element were the elastomeric O-ring not fitted. As the supply pressure increases and the water velocity increases through the discharge passages 38 the static pressure differential across the elastomeric O-ring increases according to the Bernoulli hydraulic equations causing the elastomeric O-ring to deflect into the discharge passage ways 38 but being held from closing off the discharge passage ways by the support ribs 36.

The effect of this process is that the flow control element limits the maximum flow rate of water through the element to a roughly constant value provided the water supply pressure is above a threshold minimum value. If the supply pressure is below the threshold minimum value then the flow rate will reduce with reducing water pressure but the detergent mixer will still provide a constant mix ratio of detergent to water due to the hydraulic equations in the venturi throat which have been previously explained. If the water pressure is very low the flow control element may be removed from the detergent mixer assembly.

In practice it is often desired to mix detergent with water at a low concentration on one occasion and at a high concentration on another occasion. In the detergent mixer assembly this is achieved by having more than one metering orifice 22 in the eductor tube 4 which may be selected by rotating the eductor tube within its housing 2.

In the following example the eductor tube is described as having two metering orifices 22 but it may well have more or less according to the specific design of the eductor tube.

Figure 2:
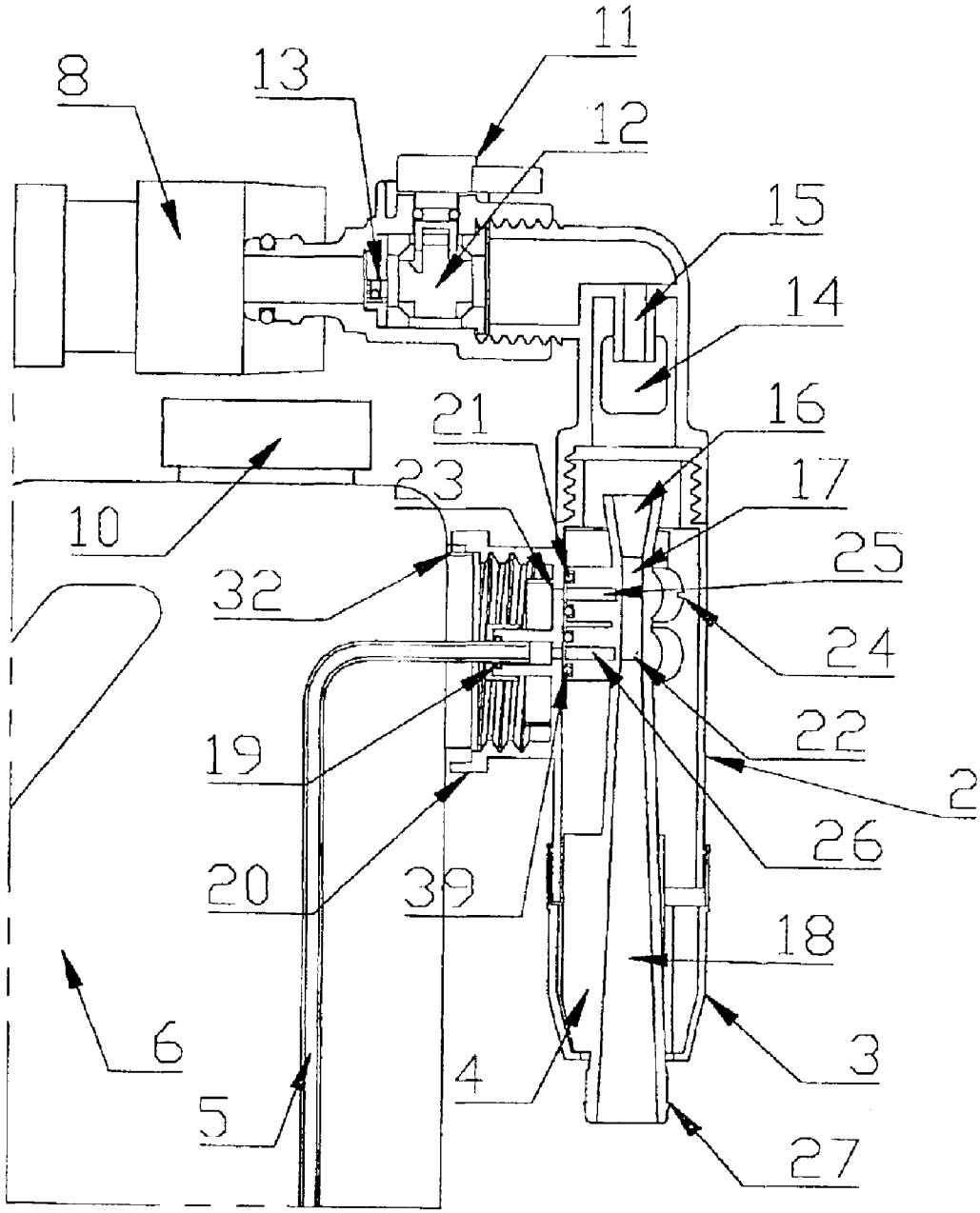
FIG. 2 is a cross sectional view of the detergent mixer assembly.
Figure 3:
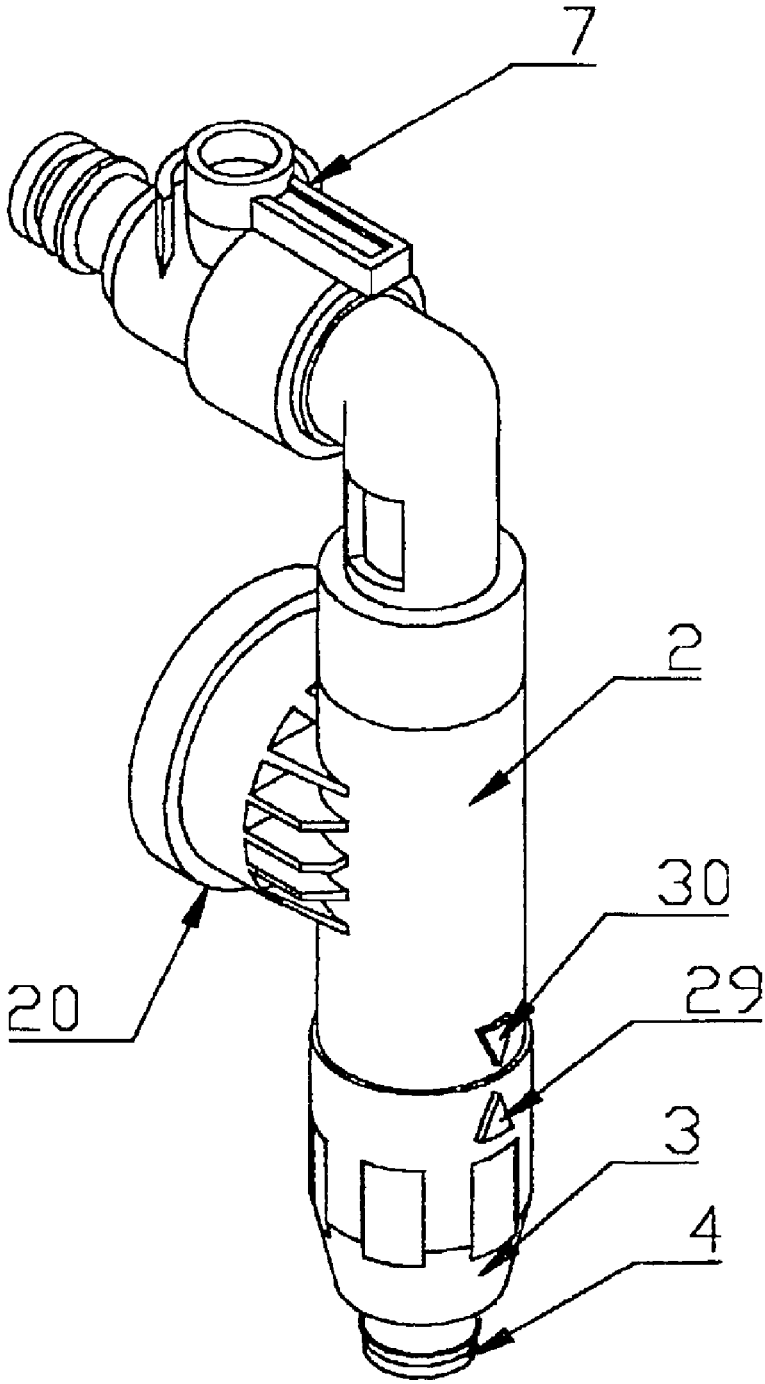
FIG. 3 is an isometric view of the detergent mixer assembly.
Figure 4:
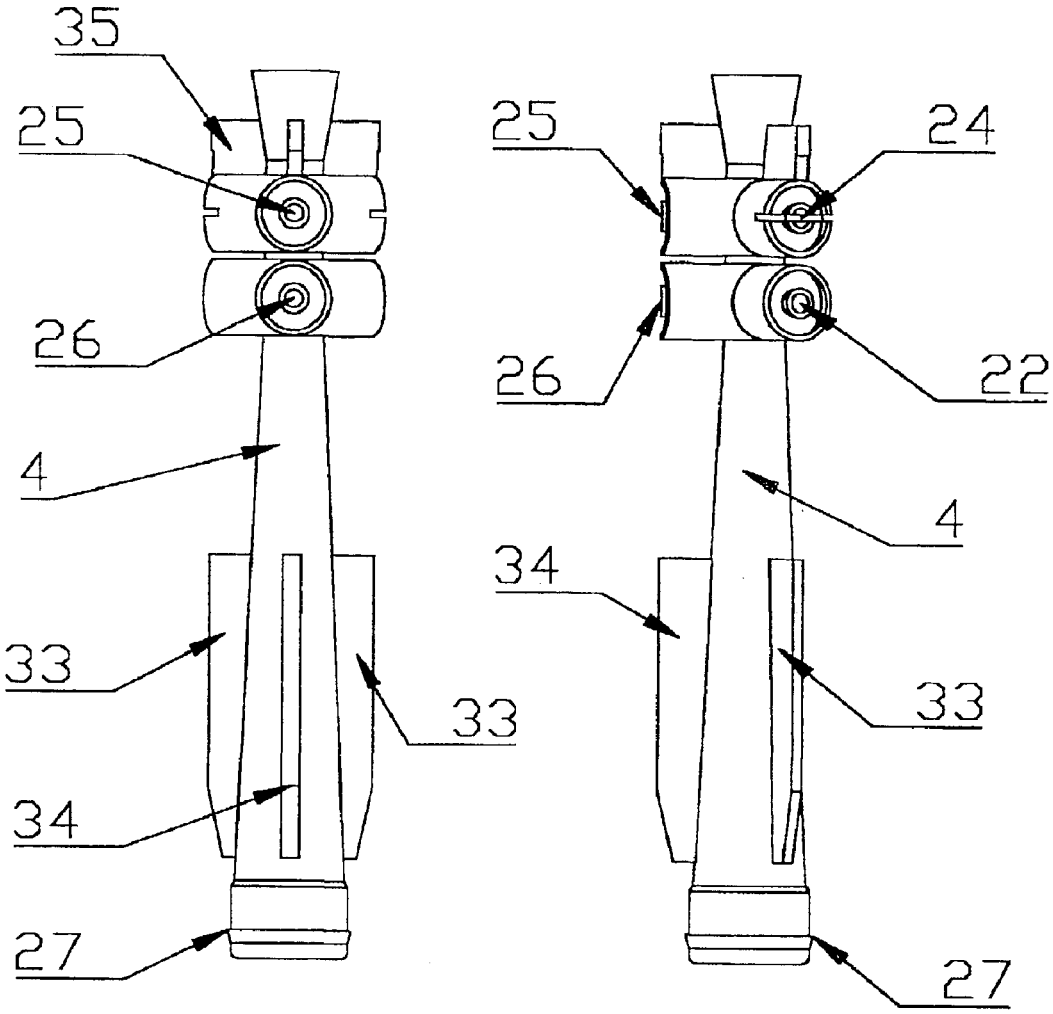
FIG. 4 is a detailed view of the eductor tube within the detergent mixer assembly.
Figure 5A:
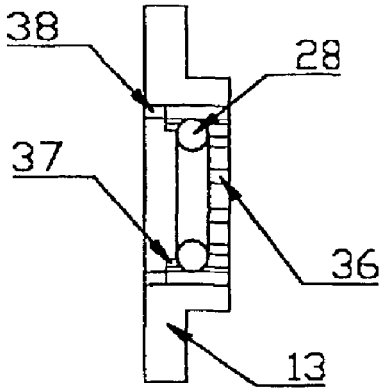
FIG. 5*a* is a cross sectional view of the water flow controller including the elastomeric flow control ring.
Figure 5B:
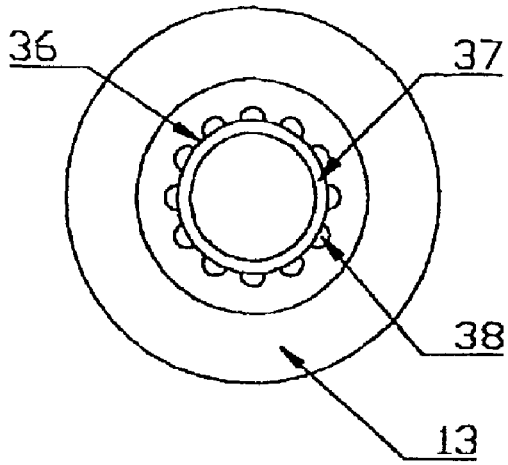
FIG. 5*b* is an end elevation of the water flow controller with the elastomeric flow control ring removed.
Figure 5C:
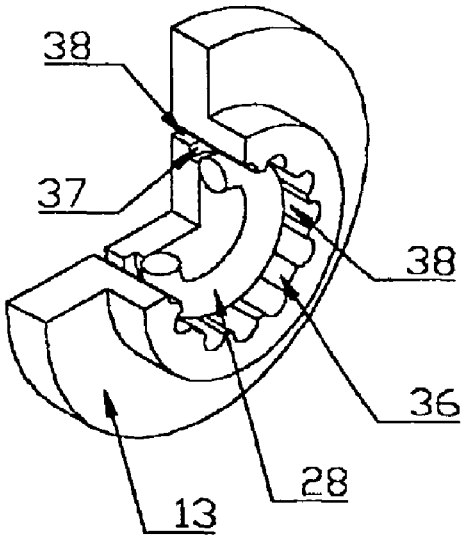
FIG. 5*c* is an isometric view of the water flow controller including the elastomeric flow control ring.
Figure 5D:
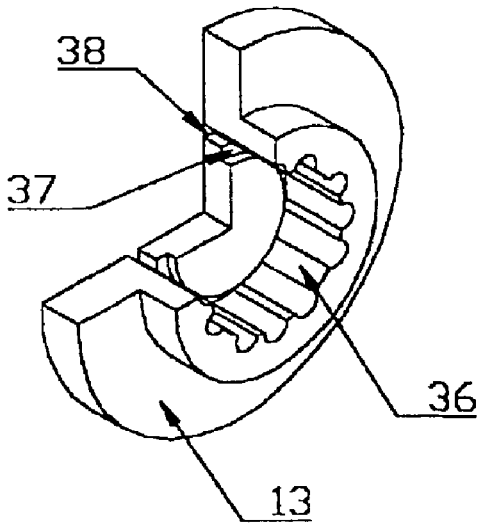
FIG. 5*d* is an isometric view of the water flow controller with the elastomeric flow control ring removed.

With reference to FIGS. 2, 3 and 4 it can be seen that the eductor tube 4 is mounted within the mixer body housing 2 and may be rotated within that housing by means of a knob 3. The knob 3 and the housing 2 may be fitted with a control mark 29 on the knob and another control mark 30 on the housing to indicate the relative rotation of the eductor tube within the housing. The control knob may also have moulded plastic detents (not shown) which click into place when the eductor tube is rotated into a specific alignment position. The control knob and housing may also have limit stops (not shown) to limit the rotation of the eductor tube in both the clock wise and counter clock wise direction to provide ease of operation of the assembly.

The eductor tube displayed in the diagrams of FIG. 2 and FIG. 4 has two metering orifices 22 which are sealed to the mixer body housing by means of O-ring seals 39. One of the metering orifices is larger than the other and when a specific metering orifice is aligned with the detergent suction line 5 the detergent suction path is sealed from atmospheric pressure by the O-ring seal to the mixer body 39 and by the O-ring seal 19 connecting the detergent suction line 5 to the mixer body 2.

To enable detergent to be withdrawn from the detergent container 6 it is necessary to connect the inside of the container to the atmosphere. This is achieved by means of a passage 23 connecting the interior of the detergent container above the top level of the detergent to the inside of the mixer body and from there to atmosphere through the air gap 14.

In practice it is desirable to be able to close off all connections to the interior of the detergent container so that detergent will not leak when the mixer assembly is not in use or while the complete assembly of the detergent container and mixer assembly are being transported. This is achieved by having a dummy metering orifice 26 which is in fact closed. When this orifice 26 is aligned with the suction tube 5 the suction line path is sealed from the atmosphere by means of the O-ring seal 39 sealing the closed dummy metering orifice to the mixer body and the O-ring 19 sealing the suction line 5 to the mixer body. The air vent to the interior of the detergent container must also be sealed from the atmosphere to avoid leakage. This is achieved by means of a second dummy closed orifice 25 which is sealed to the mixer body by an O-ring 21 and which aligns with the air vent passage 23. Thus when these two dummy orifices are aligned with the detergent container suction line and air vent the contents of the container are sealed from leakage to the atmosphere.

The O-ring seals 21 and 39 sealing the eductor tube to the mixer body are necessarily small in dimensions. For these seals to be effective they must have a minimum amount of compression on the elastomeric material. To maintain this compression on the seals the eductor tube must be held centrally within the mixer body. The eductor tube is located centrally with in the mixer body by wings 35 at its top end and by flutes 33 and 34 at its bottom end. The flutes at the bottom end of the eductor tube engage with grooves (not shown) in the rotation knob 3 to enable the eductor tube to be rotated by the knob. As an assembly aid one of the flutes 34 is wider than the other two to assure correct alignment of the rotation knob and its indicator mark 29 with the eductor tube.

To further assure balanced forces on the O-ring seals and effective sealing the assembly is designed with the metering orifices and their seals in a balanced array, in this case an array of three units being two open metering orifices and one closed dummy metering orifice set at 120 degrees radially spaced around the eductor tube. If there were to be three open metering orifices and one closed dummy orifice then the array would be of four units set at 90 degrees radially spaced around the eductor tube.

In addition to the metering orifices there is an O-ring seal 21 to close off the vent passage 23 to the detergent container. This seal would place an unbalanced force on the eductor tube leading to the possibility of leakage if it were installed in isolation. To avoid this two other similar dummy seal protrusions 24 are provided for the orientation of the eductor tube when the detergent container is required to have a vent path to atmosphere. The dummy seal protrusions are fitted with an O-ring seal to balance the O-ring seal forces on the eductor tube but the sealing assembly has a groove placed in it to provide the necessary air path to the atmosphere. By these means the forces on the O-rings corresponding to the vent passage are balanced and the vent passage is only sealed from the atmosphere when the eductor tube is rotated to the correct orientation to seal off the detergent container.

To facilitate the alignment of the seals of the eductor tube with their corresponding ports in the mixer body the eductor tube is constrained axially within the mixer body by the wings 35 against a step protrusion at the top of the mixer body and by the flutes 33 and 34 against the rotation knob 4 which is connected to the mixer body is such a way that it is constrained against axial movement. This constraint may be achieved by a snap fit together of the components using mating grooves (not shown) if the items are manufactured from a moderately flexible material such as plastic.

In many cases the contents of the detergent bottle may be considered hazardous to people when they are handled at their full concentration. With this mixer tube assembly the detergent container may be supplied with the mixer assembly already connected and the eductor tube rotated to its closed position to avoid the leakage of the contents. To further avoid hazardous operation the mixer assembly and the container filling opening 10 may be permanently connected to the container so that operators are not able to remove them and come in direct contact with the undiluted container contents.

Such a non removable closure of the detergent container may be effected by means of a tapered lug with a ramp 32 on the threaded portion of the mixer body engaging past a step on the detergent container when the unit is assembled. By these means the unit may be assembled with the step on the container and the lug on the mixer body deflecting to permit assembly but once assembled to components snap into place with no ramp being present to deflect the components to permit disassembly. Alternative means are available to seal the mixer body and the filling cap to the container such as those used with bottled food stuffs to seal the bottles with a seal which must be broken to remove the contents. If the seal is made strong enough that it cannot be broken then the container is sealed against accidental contact with its contents.

When the detergent mixer is in correct operation there is no air induced into the water stream and the water and detergent mixture exits the inductor tube as a clear stream without foam or bubbles. On most occasions this stream may be allowed to fall directly into a delivery container for the diluted detergent. On some occasions as this mixture enters the delivery container it may lead to unacceptable foaming due to the entrainment of air as the stream from the eductor tube enters the delivery container.

To ameliorate this condition the eductor tube is fitted with a barb 27 which will permit a short length of hose to be simply pushed on to the eductor tube. This hose may then be submerged below the surface of the solution in the delivery container thus avoiding the entrainment of air and the consequent foaming of the solution.

In some applications it may be desirable to make the detergent mixer removable from the detergent container so that one mixer may be used on a number of containers whilst still preserving the operator safety in terms of avoiding contact with the detergent in the container. An arrangement to effect this application is shown in FIGS. 6*a*, 6*b*, 7*a* and 7*b*.

Figure 6A:
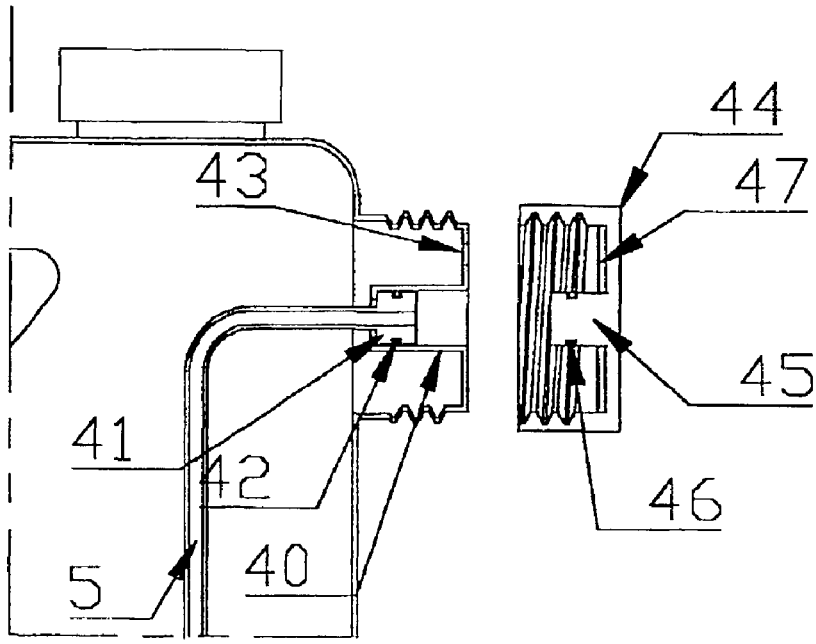
FIG. 6*a* is a cross section view of a detergent container and its cap suited for use with a detergent mixer which is removable from the detergent container.

With reference to FIG. 6*a* the detergent container moulding had been modified to provide closed surfaces where the detergent mixer connects to the container. The closed surfaces include a female receptacle 40 to which the suction line 5 is sealed by means of a moulded fitting 41 and an o-ring seal 42. The closed end surfaces of the container connection have a passage 43 formed to permit air to enter the container as detergent is withdrawn.

Figure 6B:
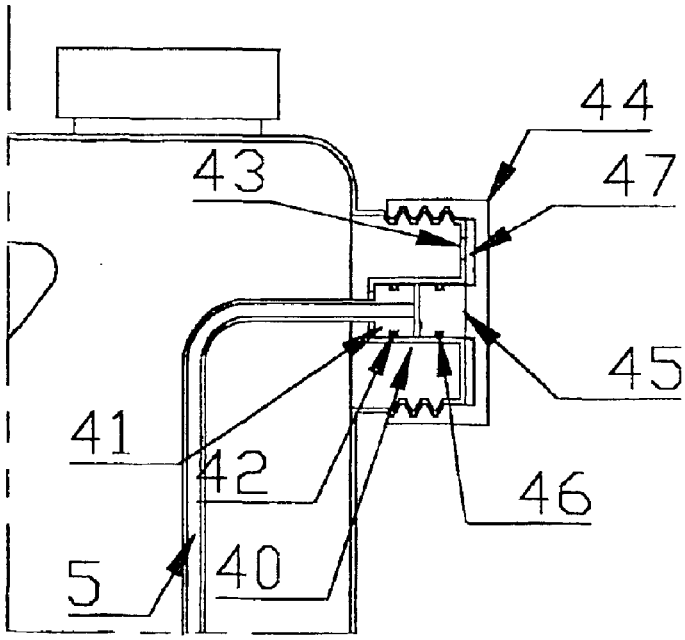
FIG. 6*b* is a cross section view of a detergent container and its cap suited for use with a detergent mixer which is removable from the detergent container with the cap assembled to the container.

To permit transport of the container it is shipped with a transport cap 44 which has a male spigot 45, a male spigot seal 46 and a cap seal 47. When the cap is assembled to the container as shown in FIG. 6*b* the male spigot and seal of the cap 45 & 46 seal off the female receptacle 40 preventing the egress of any detergent from the suction line 5 and the cap seal 47 seals off the passage 43. With this arrangement of seals there is minimal escape of detergent when the cap is removed from the container.

Figure 7A:
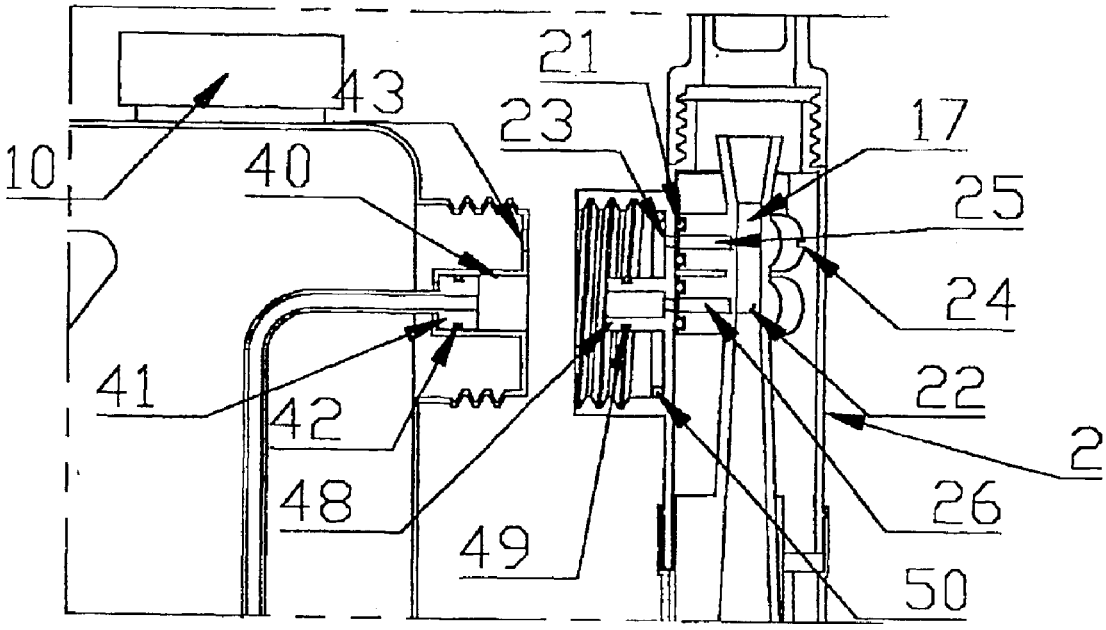
FIG. 7*a* is a cross section view of a detergent container and a detergent mixer suited for use where the detergent mixer is removable from the detergent container.
Figure 7B:
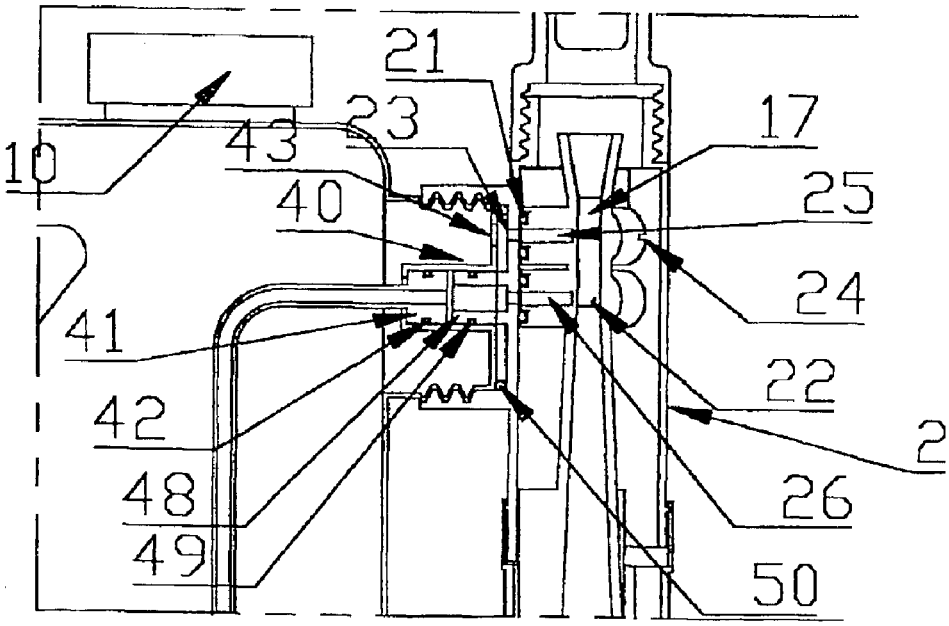
FIG. 7*b* is a cross section view of a detergent container and a detergent mixer suited for use where the detergent mixer is removable from the detergent container with the detergent mixer assembled to the container.

To enable the detergent mixer to be connected to the modified container the connection details of the detergent mixer are modified as shown in FIG. 7*a*. The suction tube seal (19 in FIG. 2) is modified to a male spigot 48 with an external o-ring seal 49. An additional o-ring seal 50 is fitted to seal the detergent mixer body 2 to the closed end surface of the container connection.

The detergent mixer is shown screwed on to the container in FIG. 7 where the male spigot 48 of the mixer body is sealed into the female receptacle 40 of the container connection providing a suction path for the detergent from the suction tube to the venturi throat 7 via the venturi suction holes 22. An air path is provided to the top of the liquid in the detergent container to permit the detergent to be withdrawn without creating a vacuum in the container. This air path is effected through the eductor vent connections 24 followed by the vent hole 23 in the eductor body and the vent hole into the detergent container 43. When the eductor is rotated to seal off the supply of detergent to the venturi the air vents are also sealed off by the closed vent connection 25 preventing any loss of detergent from the container as it is handled or moved.

Figure 8:
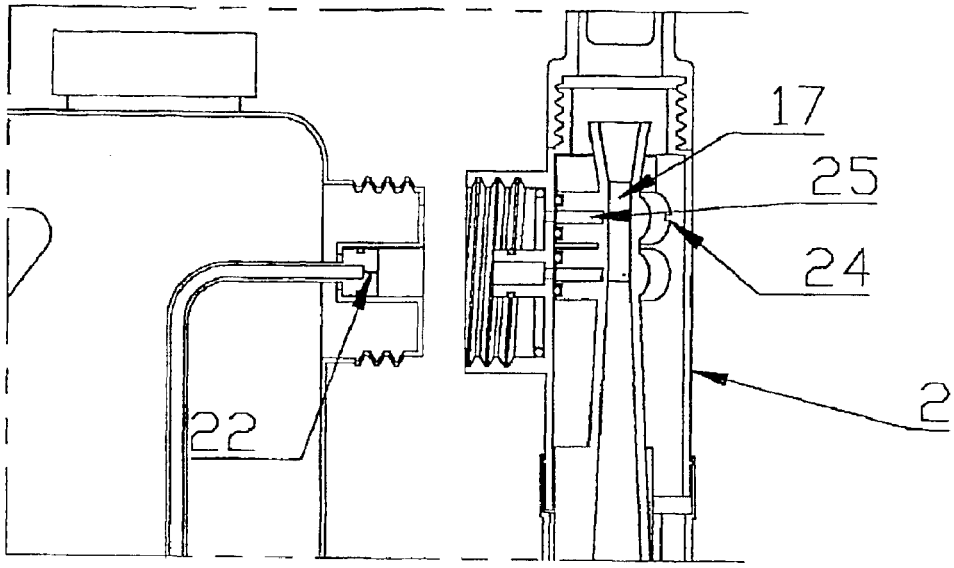
FIG. 8 is a cross section view of a detergent container and a detergent mixer suited for use where the detergent mixer is removable from the detergent container and a metering orifice to control the flow of detergent is a part of the detergent container rather than the detergent mixer.

In some applications it may be desirable to set the maximum dilution rate of the detergent according to the specific detergent in the detergent container. Under these circumstances a separate plug like venturi metering insert with the appropriate orifice 22 may be a part of the detergent container as is shown in FIG. 8.

Figure 9A:
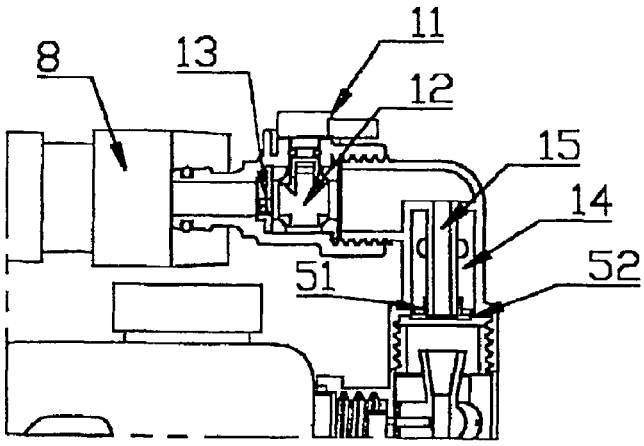
FIG. 9*a* is a cross section view of a detergent mixer inlet section where a splash guard has been added to minimise splash bach through the mixer's air gap.
Figure 9B:
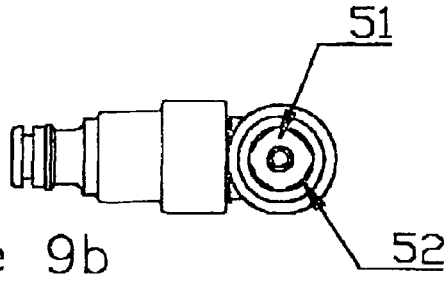
FIG. 9*b* is an end elevation view of the splash guard of FIG. 9*a*.

In operation there is often a lot of splash due to the supply water stream from the delivery orifice 15 not perfectly entering the throat of the venturi. This splash may become visible in the air gap 14. To ameliorate this condition an annular splash guard 51 as shown in FIGS. 9*a* and 9*b* may be fitted. The splash guard has a small opening or one or more gaps 52 around its perimeter to prevent siphon back of detergent to the water supply in the event of loss of water pressure.

The splash guard shown in FIG. 9*b* has the added advantage that if correctly designed it centres the water supply delivery orifice 15 to the throat of the venturi to minimise splash.

Figure 10:
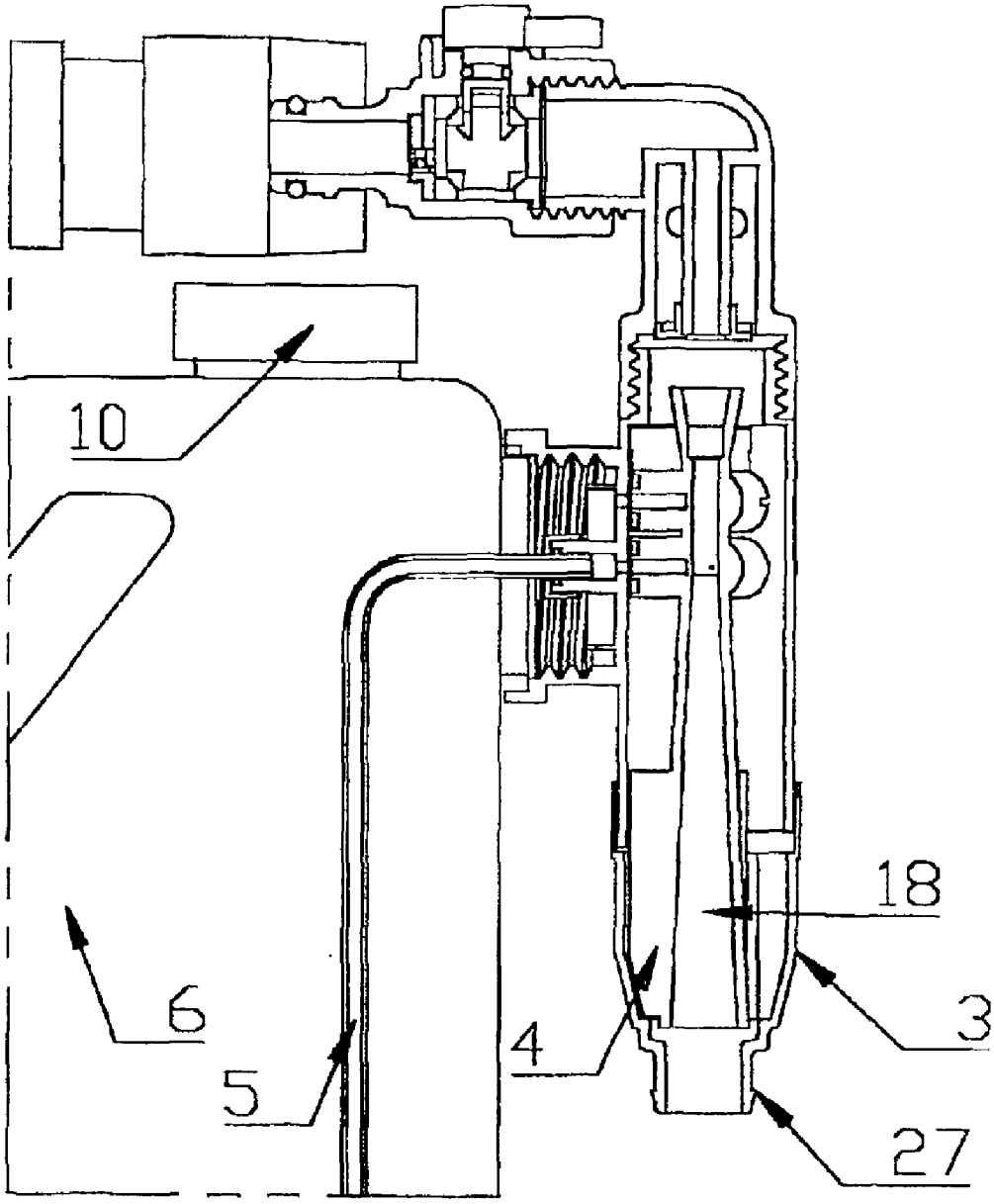
FIG. 10 is a cross section view of a detergent mixer with an alternative method of attachment of a hose to a barb to minimise foaming.

If excessive splash is present, even after installing a splash guard, it may appear on the outside of the hose attached to the barb 27 used to ameliorate foaming. To further ameliorate this situation the hose may be connected to the knob 3 rather than the eductor tube 4. This is shown in FIG. 10 where the barb 27 is a part of the knob 3 rather than the eductor tube 4.

What is claimed is:

1. A fluid mixer comprising:

a body containing an eductor tube;

the eductor tube having one or more selectable metering orifices for drawing a first fluid into a internal throat area;

said eductor tube and its metering orifices being rotatable about a longitudinal axis with said metering orifices rotating in a plane perpendicular to said axis upon such rotation;

the body having a fitting through which the metering orifice is accessed by a supply of the first fluid upon rotation of a metering orifice into axial alignment with said fitting;

the body having an inlet above the eductor tube for a second fluid and a lower opening through which a lower portion of the eductor extends.

2. The mixer of claim 1 wherein the one or more additional selectable metering orifices are arranged around a circumference of the throat area, each opening accessible through the fitting, in turn, as the eductor is rotated.

3. The mixer of claim 2, wherein all of the metering orifices are arranged equally spaced around the throat, to aid centering eductor within the body.

4. The mixer of claim 1, wherein the eductor has radial fins which act to center the eductor within the body.

5. The mixer of claim 1, wherein the inlet further comprises a flow control device which provides a relatively constant flow above a preestablished threshold.

6. The mixer of claim 1, wherein the eductor is restrained in axial movement by a knob which fits onto the lower opening and which couples with the eductor, providing an exit opening for the eductor to pass through.

7. The mixer of claim 6, wherein the knob is positioned with respect to the body by one or more detents, the one or more detents providing increments of rotation of the eductor corresponding to the one or more metering orifices.

8. The mixer of claim 7, wherein the eductor has two or more flutes for locating the eductor within the body;

one flute being wider than the rest, the knob having only one cooperating slot for the wider flute to prevent improper assembly.

9. The mixer of claim 1, wherein an upper portion of the eductor is tapered toward a narrowing in the throat area.

10. The mixer of claim 1, wherein there is provided an air gap between the inlet and a top portion of the eductor.

11. The mixer of claim 10, wherein the top portion is tapered.

12. The mixer of claim 1, wherein the eductor has a lower portion which tapers outwardly from the throat down.

13. The mixer of claim 1, wherein the eductor has a terminal portion which includes a circumferential barb.

14. The mixer of claim 1, further comprising a reservoir for the first fluid, permanently attached to the inlet.

15. The mixer of claim 1, further comprising:

an air vent located above and matched with each metering orifice, the air vent accessible through the fitting.

16. A fluid mixer comprising:

a body containing a rotatable eductor tube;

the eductor tube having one or more selectable metering orifices for drawing a first fluid into an interal throat area;

the body having a fitting through which the metering orifice may be accesses by a supply of the first fluid;

the body having an inlet above the eductor tube for a second fluid and a lower opening through which a lower portion of the eductor extends:

the eductor is restrained in axial movement by a knob which fits onto the lower opening and which couples with the eductor, providing an exit opening for the eductor to pass through, and;

wherein the knob is positioned with respect to the body by one or more detents providing increments of rotation of the eductor corresponding to the one or, more metering orifices.

* * * * *

UNITED STATES PATENT AND TRADEMARK OFFICE

CERTIFICATE OF CORRECTION

PATENT NO. : 6,877,890 B2
APPLICATION NO. : 10/203164
DATED : April 12, 2005
INVENTOR(S) : Bruce Alan Whiteley It is certified that error appears in the above-identified patent and that said Letters Patent is hereby corrected as shown below:

On Cover Page, Section (54) and at column 1, line 1 please delete the title as printed "FLUID MIXER WITH ROTATABLE EDUCATOR TUBE AND METERING ORIFICES"

and with replace with correct title
--FLUID MIXER WITH ROTATABLE EDUCTOR TUBE AND METERING ORIFICES--.

Signed and Sealed this

Twenty-ninth Day of August, 2006

JON W. DUDAS
*Director of the United States Patent and Trademark Office*